US005876291A

United States Patent [19]

Dubose

[11] Patent Number: 5,876,291

[45] Date of Patent: Mar. 2, 1999

[54] GOLF PRACTICE SCREEN

[76] Inventor: David D. Dubose, 14503 Woodforest Blvd., Houston, Tex. 77015

[21] Appl. No.: 846,332

[22] Filed: Apr. 30, 1997

Related U.S. Application Data

[63] Continuation-in-part of Ser. No. 703,484, Aug. 27, 1996, abandoned.

[51] Int. Cl.[6] ..... A63B 69/36

[52] U.S. Cl. ..... 473/197; 473/400

[58] Field of Search ..... 473/197, 172, 473/195; 273/400, 401, 402, 421, 471, 476

[56] References Cited

U.S. PATENT DOCUMENTS

| | | | |
|---|---|---|---|
| 2,823,034 | 2/1958 | Bingham | 273/26 A |
| 4,326,717 | 4/1982 | McClimon | 473/197 |
| 4,858,922 | 8/1989 | Santavaci | 473/197 |
| 5,088,740 | 2/1992 | Peterson | 273/410 |
| 5,277,430 | 1/1994 | Naccarato | 273/400 |
| 5,407,211 | 4/1995 | Bottiglieri | 473/197 |
| 5,571,266 | 11/1996 | Nichols | 273/400 |

*Primary Examiner*—Mark S. Graham
*Attorney, Agent, or Firm*—Gunn E Associates

[57] ABSTRACT

A method and apparatus for practice of a golf drive is set forth. The ball is driven from a simulated tee area against an upright sheet of flexible material such as heavy cotton ducking or nylon mesh. This sheet is deployed in a vertical upright position in the open doorway of a garage or under the eave thereof and is supported by at least two corner located taut bunge cords. An optional third is located at a center point. The several cords hold the sheets in a resilient fashion so that it can yield and snap back in response to a golf ball driven against the sheet. In an alternate form, a rectangular sheet connects on three sides to a safety net and the net connects to a frame having a central horizontal portion.

9 Claims, 3 Drawing Sheets

FIG. 4
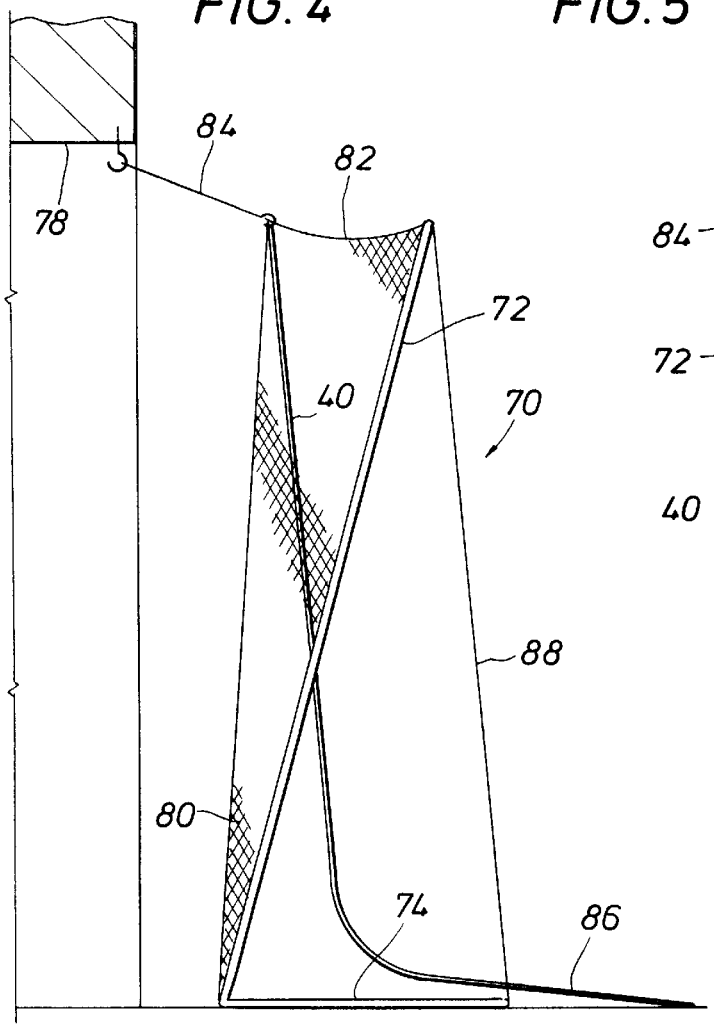
FIG. 5
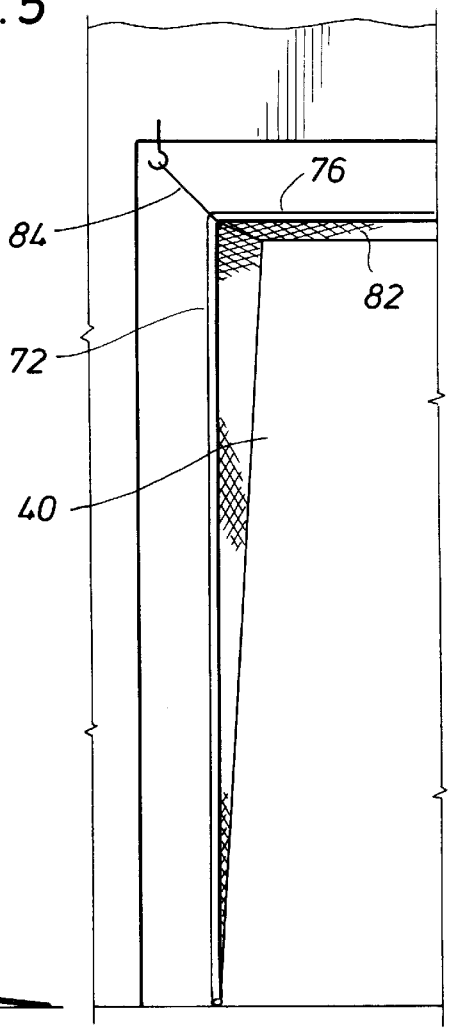
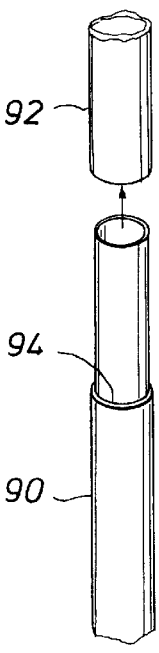
FIG. 6
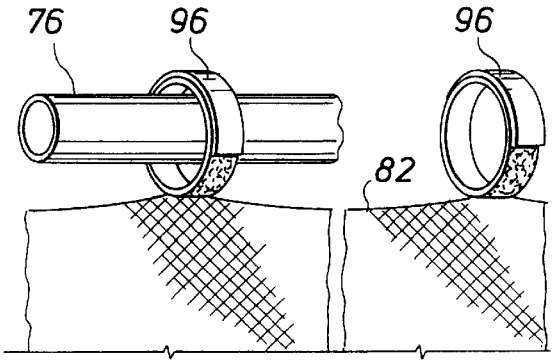
FIG. 7

GOLF PRACTICE SCREEN

This is a continuation-in-part of application Ser. No. 08/703,484 filed Aug. 27, 1996 now abandoned.

BACKGROUND OF THE DISCLOSURE

The present disclosure is directed to a screen which is useful for a golfer, and is useful to enable the golfer to practice driving. Practice for the play of golf requires very little area for putting, requires a larger area for certain irons but requires a very large area to practice with a driver. While professional golfers can drive the ball 300 yards or farther even those who play very little can drive the ball 200 or more yards thereby requiring a very large practice area. The area becomes greater taking into account errant balls hit to the right or left, thereby requiring both a long and wide area. A number of devices have been set forth heretofore to enable practice in a smaller or confined space. The present disclosure is such a device which enables driving practice to be conducted on premises. In other words, it is a device that can be put in the back yard to enable a golfer to practice without requiring a large surface area. The device of this disclosure is a device which can readily be attached to the garage or carport of a home owner. This enables the practice swing to be perfected. It does not require a large area measuring several acres where the golf ball may roll to the border or fence.

A typical driving range can cover several acres of mowed area. It is relatively expensive to use habitually, and is equally inconvenient to find one because of the large space required by a driving range. As set forth in a number of competitive devices, the equipment of this disclosure enables one to practice driving without requiring such a large area. It is particularly adapted for convenient installation and removal for storage. When removed, the device can be rolled into a small bundle. In an optimum version, it preferably hangs inside the doorway of a double car garage, i.e., a garage which has a single door for both sides. A smaller version can be made to hang where a single garage door is normally positioned. In the double car arrangement, the door is typically about 16 to 20' in width. The device of this disclosure is constructed so that it is formed of a canvas of relatively heavy construction which hangs in the door frame. A typical door frame of that sort is about 8' tall and about 18' wide. In the version described, the door frame of the garage is used as a support. This means that the device of this disclosure can be coiled or rolled and stored. That requires very little storage space. Moreover, a large supportive frame is not needed; rather, the garage will suffice.

With a view of using the overhang of a typical garage door, and especially the door frame which affords an opening of about 8'×18', the present disclosure is enhanced with an optional metal frame which leans forward to support the target area (described below) surrounded by a safety net. Going now to the frame, the frame from the front resembles an inverted U-shaped member. It is sized so that it stands perhaps 7' tall and has a width to fit within the garage door, i.e., about 14' to 17' in width. It is an inverted U-shaped member which joins by stabbing components together. This enables easy disassembly and storage. The frame is ideally a set of plastic or metal tubes in the range of about 1" to about 2" in diameter and they are formed of relatively thin wall stock. A set of hook and loop straps (sometimes known as Velcro®) is used to anchor the safety net. The safety net is located between the metal frame in this embodiment and the target (described below). The safety net surrounds it on both sides and at the top so that the entire arrangement provides enhanced safety. That embodiment will be detailed significantly below.

The golf practice screen of the present disclosure is a large expanse of relatively heavy cloth such as cotton or nylon mesh. It has the form of a large tarpaulin of porous mesh material and is ideally waterproof so that water damage does not occur. It is constructed with a heavy or beaded hem or border which is sewn with relatively heavy stitching and eyelets are located at selected locations to anchor the large canvas sheet. The canvas sheet of the present disclosure is especially adapted to be hung in the frame of a door. It is hung using elongate springs. Typically, they have a relaxed length of up to about three feet in length. While they can be made longer, that generally is not needed. They are preferably hung on a number of conveniently installed eyelets at the garage door frame so the canvas drape can be installed, used and then stored. Deployment for installation and subsequent removal, rolling and storage requires only a few minutes. This can be accomplished with the large sheet member of the present disclosure.

One embodiment hereof incorporating a safety net should be considered also. It is able to be assembled or disassembled quickly. It is formed with an external support frame which is joined by assembly of elongate tubular members formed of thin wall metal or plastic stock. The frame is sized so that it surrounds the mesh or canvas target. It is also protected with an encircling safety net. The safety net is included to stop unwanted rebounds from errant shots. While an experienced golfer may well not need the safety net, it is incorporated so that those who have less experience will have greater protection. More will be noted concerning this below.

The golf practice screen of the present disclosure contemplates an upstanding screen which is anchored inside the door frame of a garage door. This permits the user to step off a few paces. locate a mat which serves as the tee area, and practice driving. This enables practice without the risk of driving the golf ball at extremely high velocity against a hard surface which rebounds the ball back in the face of the user. That can be dangerous. The present disclosure sets forth a large target area which is hung somewhat tautly so that the rebound of the golf ball from the large target area is relatively soft or gentle. Indeed, the mesh target area can be marked with a painted or stenciled target as will be described so that the golfer knows where the drive should be hit, and the user is therefore able to drive golf balls repetitively into the target. Indeed, practice for a number of strokes is permitted because retrieval is not difficult. The large mesh sheet catches each drive, and returns it more or less toward the user at a slow velocity.

Mention should be made of the target material. The preferred form is an open mesh in which the openings are relatively small. Ideally, an open mesh material is preferably waterproofed with a coating. Coating with a soft vinyl dip on the mesh creates a surface which withstands substantial abrasion and impact. The impact is dissipated in the resilient vinyl material placed on the mesh. The mesh is made sufficiently small that there is no chance whatsoever that the golf ball will pass through the mesh. By using a mesh, easy flexure is accomplished at the time of impact.

Furthermore, the target area, while plain in one version, is marked with colors to set forth a specified target or scene. As described, the targets ideally should prompt the person practicing with the equipment to shoot at a specified region of the target area. Therefore, the target, exemplified by a bulls eye, is painted or otherwise put on the mesh or ducking that makes up the target area. Significant color contrasts can be accomplished by utilizing colored vinyl dip material which is placed on the mesh. The dip material serves the added purpose of absorbing abrasion and providing impact resistance. Also, it helps preserve the colors which are placed in the mesh.

In one aspect, the target can be formed of canvas ducking. A heavy duty cloth is used for this purpose. Again, even with heavy duty cloth, there is a tendency for the central area to wear as a result of the impact. This area is protected by incorporating a vinyl layer on it.

A safety net is optionally placed around the target in one version. The safety net comprises a marginal net of open mesh. So to speak, it is like fish net material. Again, the openings in the fishnet material are sufficiently small that the golf ball will not pass through the netting. Rather, the ball is snagged by the net material. The net material is positioned so that it presents an oblique or obtuse angle. It is deployed and supported by a U-shaped mounting frame. The safety net is ideally located on the left, top and right sides of the target area. Typically, the netting has a depth somewhere between about 20" and 48". The safety net attaches along the marginal edges to the target area. It also attaches along a supportive frame so that the safety net can hold up the target area. The target area is centered by the frame. The target area is also held behind the frame so that the safety net funnels errant shots back toward the target area. On striking the safety net first and then the target area, shots which are significantly off center can be confined with less risk.

Summarizing the present disclosure, it is a large mesh or canvas sheet which preferably hangs in the open door frame of a garage door constructed to the dimensions of about 8×18'. While the dimensions can be varied, it is optimum to position this large target mesh hanging in that area so that each drive off the tee area is directed against the canvas target. On striking the mesh or canvas target, the energy is dissipated and the ball is dropped without significant rebound. The sheet is provided with excessive height; the lower marginal edge is laid out in front of the upstanding canvas mesh or sheet. This positions the lower edge so that golf balls, after striking the target sheet, trickle down the front of the sheet and are returned when deflected back to the user.

Continuing with the present summary, an alternate embodiment is set forth which incorporates an upstanding U-shaped frame. The frame connects by means of releasable Velcro® straps to a safety net which in turn connects with the target area. The preferred target area remains a fairly heavy sheet of canvas or mesh material having a fairly durable construction which is typically made of heavy duty mesh provided with a sheet of vinyl protective layer on the outside.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 4 is a side view of the golf target of the present invention in an alternate form incorporating a safety net connected with a supportive frame for holding the target area erect;

FIG. 5 is a view orthogonal to FIG. 4 showing details of construction of the frame and safety net;

FIG. 6 is a detailed view showing assembly of the frame illustrated in FIG. 5 which is assembled by connecting bayonet type tubing ends; and FIG. 7 is a detail showing supportive loops for connecting the safety net to the supportive frame.

DETAILED DESCRIPTION OF THE PREFERRED EMBODIMENT

Figure 1:
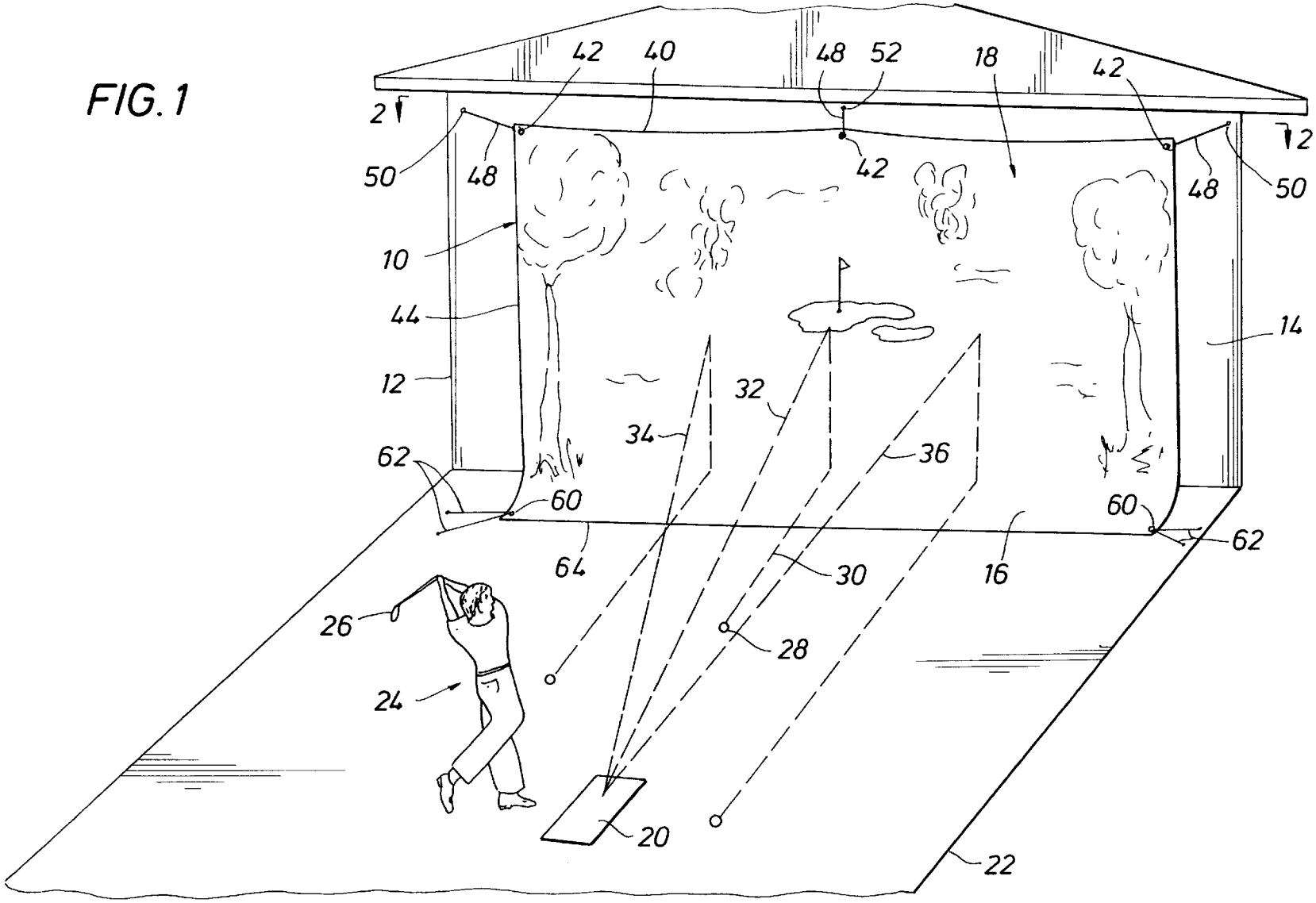
FIG. 1 shows the device of the present disclosure installed on a garage door opening at which location the user can repetitively practice driving into the vertically deployed sheet member.

Attention is first directed to FIG. 1 of the drawings which shows the present invention identified generally by the numeral 10 hanging at the front of a garage. It is ideally supported for quick mounting and dismounting from the garage. The garage 12 is a typical garage which has a door opening surrounded by a door frame 14. In this particular instance, the door frame defines an opening that is about 8×18'. As will be understood, this is merely representative. This is a typical door frame found in a garage equipped with room for two cars, wherein a single door is mounted in the door frame. The door frame 14 extends on both the left and right sides and over the top above the screen 10 of the present invention. The mounting of that will be made more clear momentarily.

The present disclosure comprises a large drape 16 which is hung from the garage. It has a simulated scene 18 on the surface which is observed by the golfer addressing the scene 18. A tee area 10 is formed with a relatively small removable rug which serves as the tee area. The rug 20 is typically about 2' in width and about 4' in length. It is appropriately aligned with the centerline of the present invention. This enables the user to address the ball at that location, driving with all his strength against the flexible practice screen 10 which is located just a few paces away. The practice tee area 20 is typically positioned between about 6 and 26 paces from the drape 16. Moreover, the practice tee area 20 is typically deployed on the driveway in front of the garage, the driveway being identified by the numeral 22. The driveway 22 provides a convenient rebound surface which assists in returning golf balls to the vicinity of the user.

Going now into greater detail, the user 24 normally uses a golf club such as a driver 26 and practices from the tee 20. This enables the user 24 to drive a golf ball 28 against the upstanding flexible drape 16 of the present disclosure. It is held substantially in an upright position meaning that the sheet member is approximately vertical with respect to the driveway 22. Generally, the driveway 22 is level but it can accommodate changes in terrain with sloping ground also. Whatever the facts, and whatever the point of application, the user 24 is enabled to locate the movable tee area and then practice from there against the mesh or canvas member which makes up the present invention. The present invention is constructed of a large sheet of heavy cotton, nylon or blended fabric ducking. It preferably is a heavier weight canvas or ducking which Is provided with some measure of waterproofing so that it will not potentially rot when stored. One acceptable form includes a mesh of nylon fibers woven in a heavy duty, durable sheet. The mesh openings are small. As described herein below, the golfer is able to drive the ball which travels on the line of flight represented by the dashed line 30. The ball is struck from the tee area 20 and travels forwardly. Using a different club with greater loft, the line of flight is higher and represented by the dash line 32. The user 24 is also shown with additional typical lines of flight at 34 and 36 which are representative of a drive with a hook or slice. As will be understood, the lines of flight inscribe a variable angle of elevation and about 15° to 20° in azimuth to the left or right as represented by the various dash lines. In all instances, they show the ball striking the image area 18 upon interception by the large canvas area in front of the user 24.

The present apparatus includes a sheet of mesh or canvas. It is relatively heavy material. As mentioned, it is preferably formed of open mesh or heavy canvas duck material. The weight can be about 6 to 12 oz. It is preferably made waterproof so it will not mildew or rot when rolled, especially after use in the rain. It is a large sheet which fits in a garage door opening typically of about 8×18'. An extra long lower portion is preferably included so that the suspended height remains 8' but the surplus drape forms a curving gutter area which kicks the balls back toward the user 24. Going momentarily to FIG. 2 of the drawings, the large sheet of mesh or canvas material has an upper seam identified at 40, and is preferably formed with a mounting eyelet 42 in each of the upper corners. The eyelets are constructed of reinforced metal grommets or the like. The marginal edge 44 (FIG. 1) is hemmed over to define a tough edge so that the cords do not fray, thereby extending life. As further shown in FIG. 2 of the drawings, the eyelet 42 is sized to receive a simple hook 46 on the end of a resilient member 48. The resilient member includes a second end with a hook 50 on it. That is momentarily hooked into a spaced eyelet 52 which is anchored in the garage door facing 14. The door frame 14 serves as the anchor for the mounting apparatus shown and described in FIG. 2 of the drawings. As further shown in FIG. 2 of the drawings, this equipment is duplicated on the left and right and especially at the upper left and right corners of the canvas drape 40. FIG. 1 shows an optional centrally located grommet 42 and the appropriate flexible member 48 which is connected to it. In that particular instance, the center located grommet 42 is supported from above so that the sheet 40 does not droop excessively. All the mounting eyelets are preferably aligned below the overhanging eave extending in front of the garage door.

Figure 2:
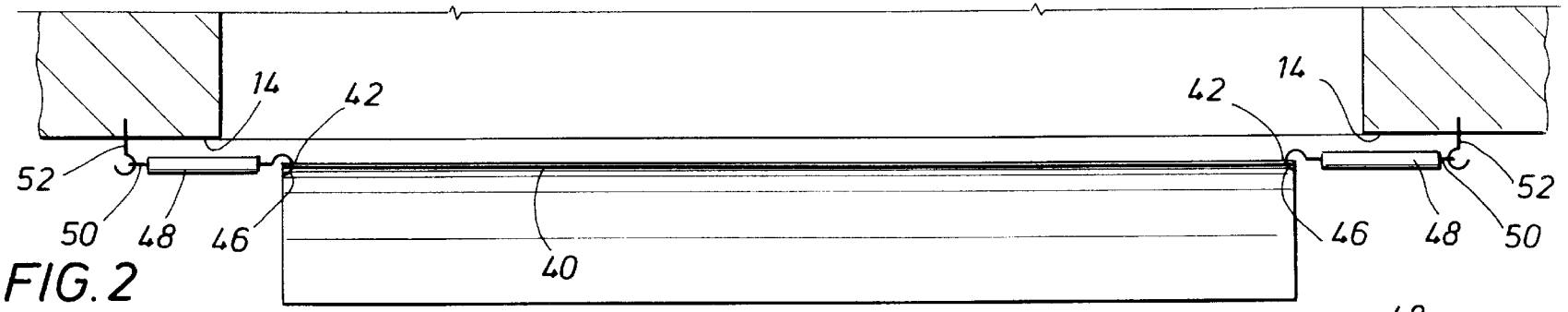
FIG. 2 is a sectional view along the line 2—2 of FIG. 1 showing the sheet member hung in a garage door opening.

Continuing with FIG. 2 of the drawings, the mounting hooks 52 do not need to extend any great length away from the door facing 14. They are relatively shallow. This permits the sheet material 40 to hang substantially in the door frame. It is highly desirable that the sheet 40 hang in front of or even with the open garage door area. In other words, there is nothing immediately behind the sheet. This permits the sheet to pop, buckle and flop back to the original position of it when a golf hall strikes it. This deployment is advantageous in that the garage door can be raised and the member 16 draped where the garage door was once located when closed, or in front of the door if closed.

Sometimes, the garage door frame 14 may encompass two independently operated garage doors which are collectively smaller in width. In that particular instance, the two garage doors involved are protected by the sheet member 16 which hangs in front of them. If the sheet is positioned parallel to the garage doors and located several inches in front of them, it may not be necessary to raise the garage door, whether hung with one large door or two smaller doors.

The deployment of the sheet of mesh or ducking cloth 40 in FIG. 2 of the drawings enables the sheet to be pulled taut so that it does not droop or sag. There is sag included in the drape 16 but that is located at the bottom which forms the curving gutter area which helps reject the golf balls and return them toward the user. To this end, the resilient members 48 must be relatively strong. More will be noted concerning their strength hereinafter.

Figure 3:
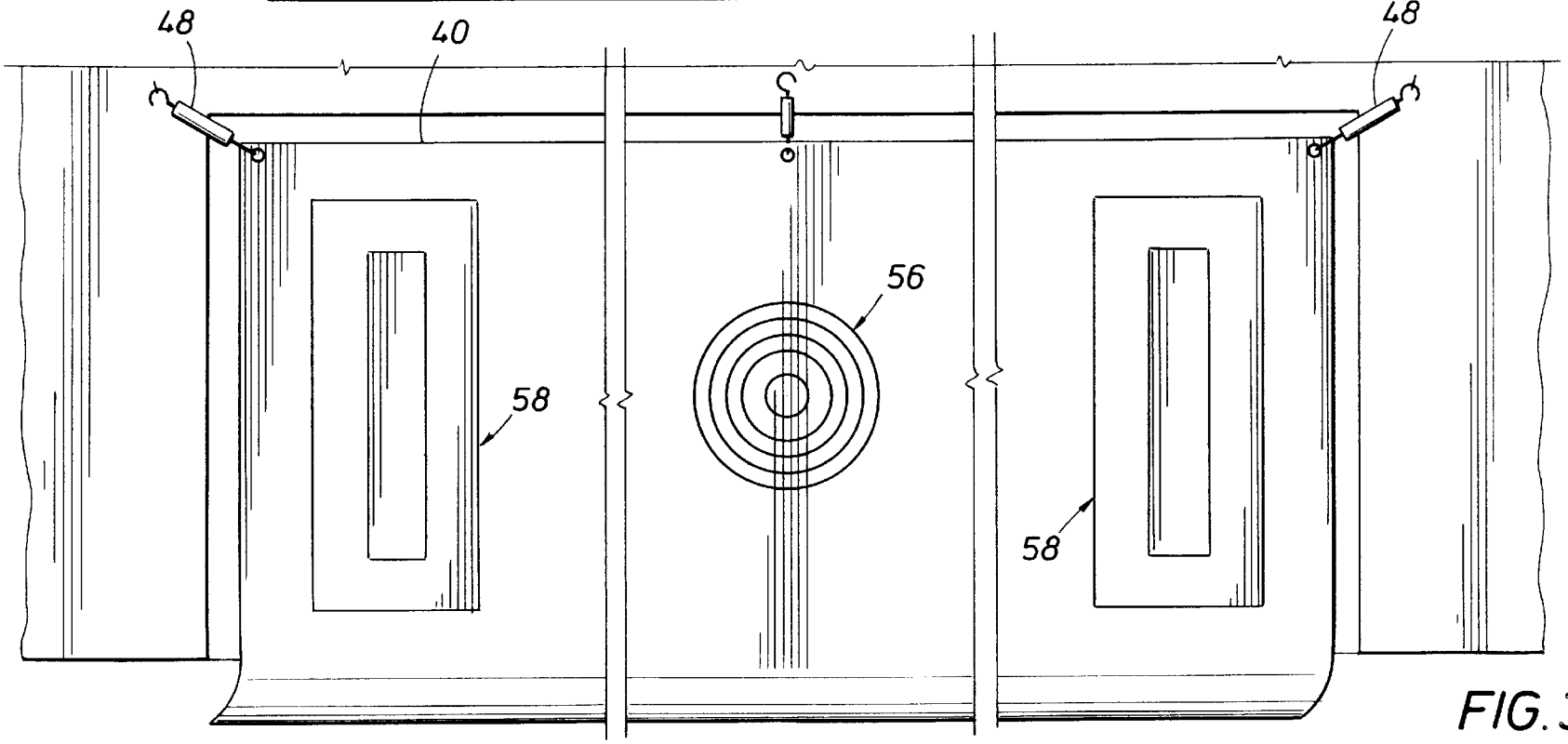
FIG. 3 is another view showing the sheet member hung from a set of garage mounted spring members.

Going now to FIG. 3 of the drawings, another aspect is shown in which the sheet member 16 has been broken into multiple components. The resilient mounting member 48 is in the mouth or opening of the carport access area. This convenient mounting mechanism suspends the sheet 16 so that the garage door is behind the sheet by a distance so that it is not struck by the golf ball. Indeed, if the garage is equipped for two cars but is provided with two doors and an upstanding post between the two, the drape 16 can be located forwardly a few inches to cover over the area of both doors. This permits protection of the two doors and the center post so that the golf ball does not strike the center post and rebound excessively. Rather, it strikes the sheet and falls down the drape 16 so that it can then roll to the bottom and back toward the golfer 24.

In FIG. 3 of the drawings, a different sheet is illustrated. In this particular instance, the sheet is provided with an alternate image. FIG. 1 shows a simulated scene from a golf course. FIG. 3 shows an alternative form with a bulls eye 56. This defines a target for the golfer 24. Alternate forms of target are shown also in FIG. 3. FIG. 3 shows an alternate target 58 which is more rectangular. The rectangular target takes into account the fact that the user may drive the golf ball against the rectangular target where loft is less important than angular misdirection. In the deployment shown in FIG. 3, the rectangular target suggests practice to accomplish a desired azimuth while the hook and slice to the side carry a smaller reward. In both instances, the target or bulls eye can be tailored to the need of the user.

Operation of the present device can be better understood upon description. The device is used by any level of amateur golfer during practice. The ball strikes the drape after being driven from the tee area 20, is caught by the drape 16 and trickles down the front face and is returned toward the user. This is accomplished by the system 10 shown in the drawings. This is accomplished simply by driving the golf ball from the tee area 20 against the drape 16. When struck with high velocity, it is relatively easy to see and understand the error that will arise by not practicing this type of drive. While practice with a putter requires very little area, practice with the woods or other drivers simply requires a great area as well as highly effective golf ball retrieval.

The retrieval aspect of the present disclosure enables practice to be carried out without requiring chasing all over the immediate geographic area. In this particular version, the user is able to drive with full strength, thereby striking the drape at a location exemplified by the trajectory paths shown in FIG. 1 of the drawings.

The present disclosure sets forth an improved mounting system for the drape 16. Going specifically to FIG. 2 of the drawings, the resilient member 48 is equipped with hooks at both ends. This enables it to be mounted or dismounted depending on the convenience of the user. In the mounting system, a good deal of shock dissipation is achieved. The preferred mounting system utilizes a device known often as a bunge cord. It is equipped with hooks on the two ends. In the relaxed state, it is preferable to use a bunge cord of about two feet in length. An alternate form of resilient member is a simple coil spring. The spring is equipped with hooks at the respective ends. Devices of this sort are used along the top marginal edge of the drape 16. Typically, one is placed in the center and the remaining two are placed at the outer upper corners.

Going back now to FIG. 1 of the drawings, stability of the target is achieved by supporting the top marginal edge from two and preferably three flexible mounting devices. The resilient mounting members are shown in FIGS. 1, 2 and 3. There are, however, additional cords involved. These are represented at the bottom corners where the numeral 60 identifies a hook eyelet, and suitable lateral guy wires 62 extend outwardly from the corners. It is not necessary that the guy wires 62 be tied to any moveable member. Rather, they simply hold the sheet of material, and permit it to be firmly anchored against the ground. The lowermost edge 64 is typically in contact with the driveway 22 or other working surface.

Continuing with the description, the drape 16 of the present disclosure is a very heavy duty sheet of reinforced cloth which is marked with the target image 18 or the other targets shown in FIG. 3. It is constructed so that a desired scene can be presented to the user. Indeed, a different image can be printed on the front compared with the back of the sheet material.

Continuing with the description, the radius of curvature of the front edge leading down to the marginal edge 64 is noted. That radius of curvature is typically between about 2 to about 12". In part, it can be controlled by pulling the marginal edge 64 forward. This may slightly change the vertical hang of the vertical drape 16. This curvature is especially effective for returning the golf ball 28 toward the user. Interestingly, it has been determined that the ball is returned on the left or right of the user depending on the hook or slice. If the drive is true and straight, and the user 24 is standing at a distance on the centerline of the drape 16 and strikes the ball without hook or slice, the ball will typically be returned at the user's feet.

The bunge cord 48 can be used with various degrees of tension. The tension or force is sometimes known as a spring constant. Another factor is the percent elongation. Depending on the weight of the drape 16, the spring force can vary up to about three or four times the minimum and the percent elongation typically is in the range of about 10% to about 40%. Greater elongation normally is not required. To summarize, the bunge cord 48 hold the drape taut so that there are few wrinkles in it. It is pulled so that it is relatively planar at all locations other than the curving portions 16 toward the bottom.

Attention is now directed to FIG. 4 of the drawings where the embodiment 70 is shown in side view. This embodiment again uses the open doorway of a garage as an overhead anchor. It is, however, centered in an inverted, U-shaped metal frame. There is an upstanding member 72 which is almost vertical but which tilts forwardly at an angle of perhaps 10° to 15°. Optionally, it can be stabbed into the ground or it can be rested on a horizontal support or prop 74 as shown in FIG. 4. In either instance, this frame is formed of hollow tubular stock (to be described) and it is deployed around the rectangular target. Going momentarily to FIG. 5 of the drawings, the frame member 72 is shown in a vertical plane in FIG. 5. The horizontal portion 76 has a length which is sized to rest before a garage door opening. In the typical installation, the garage door is 8'×18'. The frame 76 will have a width of about 14' to nearly 18'. Indeed, it can even be wider than that if desired. The frame member 76 is located about 90" to 108" above the ground. Typically, it is below the overhanging cave 78 shown in FIG. 4. That again is used as a anchor for several bunge cords to be described.

Continuing with the description shown in FIGS. 4 and 5 jointly, a left marginal net 80 having the form of a safety net is located on one end. A symmetrical right hand net is located at the opposite end. The two nets at the left and right ends serve as a funnel directing errant shots toward the drape. In addition to that, there is another segment 82 of the netting. As shown in the drawings, it hangs in a slight curvature. The net 82 is just behind the frame member 76. It is attached to it and is therefore as long as the frame member 76. The net portion 82 connects with the end net portions 80. Indeed, they can be of one piece construction if desired. The net 82 is pulled taut by several bunge cords 84. As in the earlier embodiments, this flexible mounting cord is installed at several locations along the target area. As before, the target will be identified by the reference numeral 40 and it is pulled back toward a more or less upright position as shown in side view in FIG. 4. Being a long draped canvas, it had a leading edge portion 86 which can be stretched out on the ground in front of the equipment. The curvature is defined by the loosely hanging target 40. The target sheet is pulled tight and pulled backwardly from the frame member. In other words, there is tension in the net 82 and the overhanging flexible bunge cords 84. This tension of the bunge cords 84 keeps a taut condition on the target 40. The leading edge of the frame 76 is optionally anchored by a vertical guy wire 88. That call be replicated at both ends.

Considering the now the deployed equipment shown in FIGS. 4 and 5, the target area 40 is presented as before. The primary safety enhancement that is provided by the embodiment 70 is the positioning of the target area 40 recessed slightly behind the frame 72. Moreover, it is surrounded on both ends and there above with the safety net. The safety net 80 and 82 is typically one continuous member which is anchored to the frame 72. While it is shown pulled taut at the top (see FIG. 4). it may hang loosely at the bottom. In like fashion, this taut condition is illustrated in some detail in the corner construction shown in FIG. 5. The top portion of the safety net 82 is fairly taut and has only a modest curvature as a result of its own weight. It is not necessary that it be pulled significantly tighter. The net 82 on all three sides of the target 40 serves as a safety feature controlling rebounds. While a well trained player will strike only the center portions of the target 40, those with less skill may well create a high level of risk with erratic or errant shots. Such shots may completely miss the drape 40 and strike around the marginal edges. The safety net is sufficiently wide and deep that errant shots are gathered inside the frame 72 and the safety net. Such badly driven shots will then strike the marginal edges. When that occurs, the safety net material will catch the errant shots and deflect them so that the shot then strikes the drape 40. Shots which are deemed really bad are thus captured inside the flame and are diverted into the safety net and then against the drape. This dissipates most of the energy and causes the golf ball to roll rather gently back toward the golfer. This is a significant improvement over the situation which might occur otherwise in that a ball which misses the target 40 might readily strike the facing of the garage and rebound to the danger of observers and bystanders. Such rebounds are reduced in this equipment. Moreover, the embodiment 70 is constructed so that bad shots are gathered and held in near proximity.

The frame shown in FIGS. 4 and 5 is partially illustrated in FIG. 6 which shows a method of assembly. A first frame member 90 includes an end portion of reduced diameter which stabs into a mating frame member 92. That abuts against the circular shoulder 94 to stop and register the two frame members when they are assembled together Typically, the frame members 90 and 92 are formed of light weight, relatively thin wall metal or plastic and have a diameter of about 1" to about 2". The wall thickness is relatively thin so that light weight construction can be obtained. The components join on telescoping movement and can be pulled apart by hand.

FIG. 7 shows the frame member 76 which is the transverse overhead frame member which spans the width of the garage door opening in that particular embodiment 70. It releasably connects to the safety net 82. This connection is made with straps provided with Velcro® which is a trademark applied to hook and loop cloth. Such straps 96 are located at spaced locations along the safety net 82. This permits the safety net to be connected to the frame 76. Ideally, the safety net attaches at many points around the frame. Several such loops pull the safety net 82 sufficiently close to the frame members that there are practically no gaps between the net material 82 and the frame member 76. The gap shown in FIG. 7 has been exaggerated for illustrative purposes only. In the optimum circumstance, the safety net is relatively taut adjacent to the frame member 76.

While the foregoing is directed to the preferred embodiment, the scope is determined by the claims which follow:

I claim:

1. A target for use in practice of a golf swing comprising:

(a) a rectangular flexible sheet having a face presented to a golfer, said sheet having upper left and right corners;

(b) corner connected resilient members extending outwardly and upwardly from said sheet corners to thereby enable said sheet to hang substantially vertically in front of the golfer to practice a golf swing by driving a golf ball into said sheet;

(c) end located eyelets on said resilient members to be connected at ends thereof;

(d) a set of anchor eyelets adapted to be placed under the cave of a garage to hang said sheet parallel to a garage door and including left and right eyelets located beyond the door frame of the garage door;

(e) wherein said resilient members support a top marginal edge of said sheet between said corners at a specified height above a tee area and said sheet extends downwardly to the ground and is sufficiently long so that a lower marginal edge of said sheet is curved toward the user to thereby define a ball return curvature;

(f) a surrounding frame above and forward of said sheet;

(g) a safety net between said frame and sheet to deflect errant shots; and (h) a tee area wherein said golfer places a ball on said tee area spaced from said sheet to enable driving against said sheet.

2. The apparatus of claim 1 wherein said resilient members connect separately to disposed, spaced apart, elevated eyelets to enable said resilient members to extend upwardly and outwardly and to connect said end located eyelets with engaging eyelets so that said resilient members are placed in tension to support said sheet and said sheet is pulled taut there between and said safety net connects along at least two edges of said rectangular sheet.

3. The apparatus of claim 2 including left and right eyelets located beyond a door frame of the garage door.

4. The apparatus of claim 2 wherein said flexible sheet includes a circular target on said sheet and aligned with said tee area.

5. The apparatus of claim 2 wherein the flexible sheet includes an upstanding rectangular target on said sheet and aligned with said tee area.

6. The apparatus of claim 1 including multiple releasable straps connecting said safety net to said frame to secure said safety net along said frame.

7. The apparatus of claim 2 wherein said safety net has three portions connected to three portions of said frame and said frame is comprised of left and right end portions joined to a horizontal central portion.

8. The apparatus of claim 6 wherein said straps have a length enabling said straps to loop around said frame.

9. The apparatus of claim 6 wherein said safety net includes a marginal back edge hooked to said resilient members.

* * * * *